US008929755B2

(12) United States Patent
Itagaki

(10) Patent No.: US 8,929,755 B2
(45) Date of Patent: Jan. 6, 2015

(54) IMAGE FORMING APPARATUS WITH A WASTE TONER CONTAINER AND CONTROL METHOD THEREOF

(75) Inventor: Yuusuke Itagaki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 150 days.

(21) Appl. No.: 13/425,703

(22) Filed: Mar. 21, 2012

(65) Prior Publication Data

US 2012/0251210 A1 Oct. 4, 2012

(30) Foreign Application Priority Data

Apr. 4, 2011 (JP) ..... 2011-082779

(51) Int. Cl.
*G03G 21/12* (2006.01)
*G03G 21/10* (2006.01)

(52) U.S. Cl.
CPC ..... *G03G 21/12* (2013.01); *G03G 21/105* (2013.01)
USPC ..... 399/35; 399/358; 399/360

(58) Field of Classification Search
USPC ..... 399/35
See application file for complete search history.

(56) References Cited

U.S. PATENT DOCUMENTS

| | | | | |
|---|---|---|---|---|
| 8,731,415 | B2 * | 5/2014 | Hogan et al. | 399/35 |
| 8,737,852 | B2 * | 5/2014 | Aoshima et al. | 399/35 |
| 8,761,655 | B2 * | 6/2014 | Yamamoto et al. | 399/358 |
| 2004/0208657 | A1 * | 10/2004 | Kakeshita et al. | 399/27 |
| 2007/0196148 | A1 * | 8/2007 | Shishikura | 399/358 |
| 2009/0060536 | A1 | 3/2009 | Kumagai | |
| 2009/0263147 | A1 * | 10/2009 | Kumagai | 399/35 |
| 2011/0311247 | A1 * | 12/2011 | Itagaki | 399/35 |

FOREIGN PATENT DOCUMENTS

| | | | |
|---|---|---|---|
| JP | 2003-271023 | A | 9/2003 |
| JP | 2009-080473 | A | 4/2009 |

* cited by examiner

*Primary Examiner* — David Gray
*Assistant Examiner* — Geoffrey Evans
(74) *Attorney, Agent, or Firm* — Renner, Otto, Boisselle & Sklar, LLP

(57) ABSTRACT

A plurality of waste toner transport mechanisms convey waste toners per color. A waste toner container receives collectively each waste toner conveyed by each waste toner transport mechanism. An integrated number of pixels memory stores a result of an integration of the numbers of the pixels per color of the image data counted by the pixel counters after the near end detection has been made by the near end detector, the integration being carried out by an integrating number of pixels section each time an image forming is performed. A full end judgment section makes a judgment that full end, at which a quantity of the waste toner in the waste toner container reaches fullness, is attained when any one of the integrated numbers of pixels per color stored by the integrated number of pixels memory reaches a predetermined value.

6 Claims, 6 Drawing Sheets

IMAGE FORMING APPARATUS WITH A WASTE TONER CONTAINER AND CONTROL METHOD THEREOF

CROSS REFERENCE

This Nonprovisional application claims priority under 35 U.S.C. §119(a) on Patent Application No. 2011-082779 filed in Japan on Apr. 4, 2011, the entire contents of which are hereby incorporated by reference.

BACKGROUND OF THE INVENTION

The present invention relates to an image forming apparatus that receives waste toner in a waste toner container and to a method of controlling the image forming apparatus.

In image forming apparatus, the waste toner that has not been transferred onto paper and is remaining on a photoreceptor and the like is received in a waste toner container. Because the capacity of the waste toner container is limited, it is necessary for a waste toner container to be replaced with another empty one before it becomes full. Therefore, fullness of the waste toner in the waste toner container is detected by some means.

In the Japanese Patent Unexamined Publication No. 2003-271023 bulletin, it is described that using the number of pixels of image data counted by a pixel counter an integration of the number of the pixels is started when a waste toner reception quantity sensor detects that the quantity of received waste toner has reached a predetermined amount (near end), and that the quantity of received waste toner is judged to have become full (full end) when the integrated value reaches a predetermined value.

The above described conventional method, in which the full end is determined by the quantity of the waste toner that is not directly detected but is estimated from the number of the pixels, is therefore not necessarily correct. In case of a type of image forming apparatus adapted for color images, in particular, where waste toners are conveyed per color and then received collectively in a waste toner container, when the number of total pixels of image data is used as a parameter as described in the patent literature above, it cannot precisely reflect the image data since it is not the numbers of pixels counted per color.

That is to say, as shown in FIG. 6A, uneven frequencies in use of respective toners that tend toward one color is subject to the risk of causing the waste toner to overflow exceeding a fullness position of the waste toner container. Besides, as shown in FIG. 6B, relatively even frequencies in use of respective toners is even subject to the risk of a state actually with room and not yet in full-state being misjudged to be in full-state; and this results in an increased number of times of replacement of the waste toner container, adding to the troublesome task for a user.

The present invention was made in view of the above described problem, and is directed to providing a means to determine as precisely as possible fullness of a waste toner received to a waste toner container in an image forming apparatus adapted for color images.

SUMMARY OF THE INVENTION

An image forming apparatus of the present invention comprises a plurality of waste toner transport mechanisms, a toner container, a near end detector, a pixel counter, an integrated number of pixels memory and a full end judgment section. The plurality of waste toner transport mechanisms convey waste toners per color respectively. The waste toner container receives collectively each waste toner conveyed by each waste toner transport mechanism. The near end detector detects a near end, at which a quantity of waste toner in the waste toner container is close to fullness. The pixel counter counts per color the number of the pixels of image data. The integrated number of pixels memory stores a result of an integration of the numbers of the pixels per color of the image data counted by the pixel counter after the near end detection has been made by the near end detector, the integration being carried out by an integrating number of pixels section each time an image forming is performed. The full end judgment section makes a judgment that full end, at which a quantity of the waste toner in the waste toner container reaches fullness, is attained when any one of the integrated numbers of pixels per color stored by the integrated number of pixels memory reaches a predetermined value.

With this configuration, since a full end is determined by carrying out an integration of the numbers of the pixels counted per color, an appropriate full end determination reflecting the image data can be performed. Accordingly, fullness of the waste toner received in a waste toner container can be determined as precisely as possible.

DETAILED DESCRIPTION OF THE INVENTION

Figure 1A:
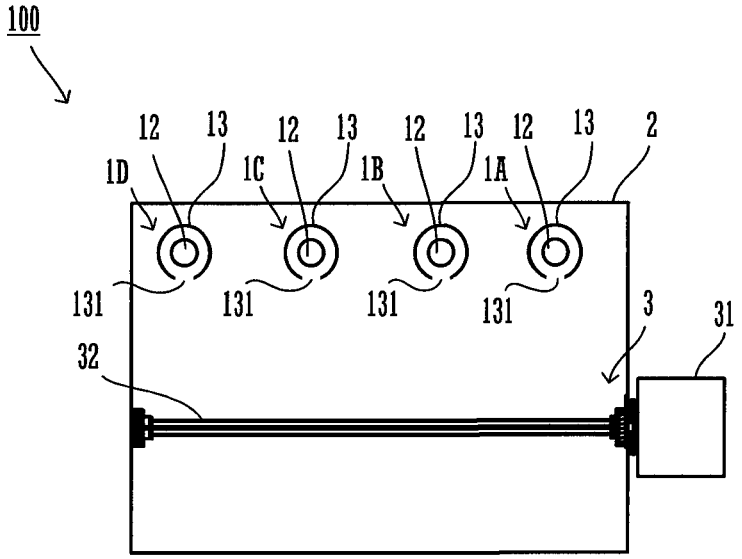
FIG. 1A is a sectional front side view showing a waste toner collector of an image forming apparatus according to an embodiment of the present invention.

An image forming apparatus of the present invention is configured so as to carry out processes including visualizing image data formed as an electrostatic latent image on photoreceptors using toners of a plurality of colors, forming a color image through transferring the visualized image on paper, then conveying per color waste toners remaining on the photoreceptors, and collecting the waste toners collectively in a waste toner container. In the following, the present invention is explained referring to the drawings, taking a tandem type full color copying machine as an example of its application.

Figure 1B:
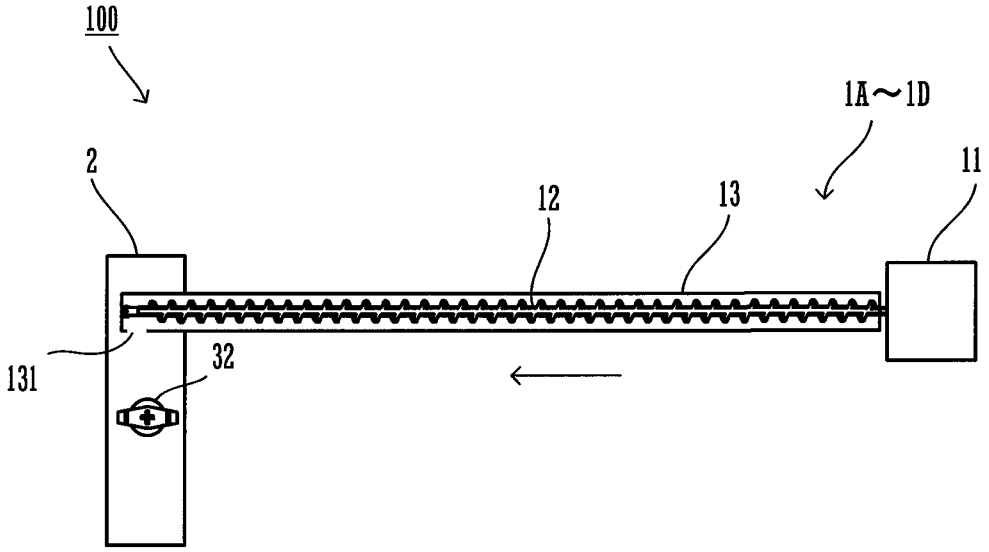
FIG. 1B is an outlined sectional side view showing the waste toner collector.

An image forming apparatus according to an embodiment of the present invention includes a waste toner collector 100 as shown in the FIGS. 1A and 1B. Specifically, the waste toner collector 100 generally includes waste toner transport mechanisms 1A through 1D, a waste toner container 2 and a waste toner stirring mechanism 3 as shown in the FIGS above.

The waste toner transport mechanisms 1A through 1D are configured so as to convey waste toners per color. In this embodiment, the index "A" shall correspond to black toner, "B" to cyan toner, "C" to magenta toner and "D" to yellow toner. To be concrete, each waste toner transport mechanism 1A through 1D, as shown in FIG. 1B, includes a tubular conveying path 13 extending rectilinearly with one end (right end in FIG. 1B) thereof directly connected to a cleaning unit of a photoreceptor not shown, a conveyance screw 12 axially inserted into the conveying path 13 and installed so as to be freely rotatable, and a conveyance motor 11 rotatively driving the conveyance screw 12.

On the underside of the other end (left end in FIG. 1B) portion of the conveying path 13 opens a toner exhaust port 131. The conveying paths 13 of the respective waste toner transport mechanisms 1A through 1D are, as shown in FIG. 1A, disposed abreast in a horizontal direction. Thus, toner exhaust ports 131 per color are also laid in line in the horizontal direction inside the waste toner container 2.

In the above-mentioned configuration of the waste toner transport mechanisms 1A through 1D, when the conveyance screws 12 are revolved by the conveyance motors 11, the waste toners are conveyed from the right to the left of FIG. 1B, and then the waste toners falls through the toner exhaust ports 131 into the waste toner container 2. In this manner, the waste toners remaining on the photoreceptors are conveyed per color and received in the waste toner container 2. In other words, while conveyance of the waste toners is carried out per color, collection of the waste toners is performed so as to receive them collectively in the waste toner container 2.

The waste toner stirring mechanism 3 is configured so as to stir the waste toners received in the waste toner container 2. Concretely, the waste toner stirring mechanism 3, as shown in FIG. 1A, includes a stirring screw 32 installed so as to be freely rotatable inside the waste toner container 2, and a stirring motor 31 rotatively driving the stirring screw 32.

In the above-mentioned configuration of the waste toner stirring mechanism 3, when the stirring screw 32 is revolved by the stirring motor 31, the waste toner accumulated in the waste toner container 2 is stirred, and thereby toners of respective colors falling from the respective toner exhaust ports 131 are mixed uniformly. In this manner, top surface of the heaped up waste toner is leveled off uniformly, so that the waste toner(s) will not pile up in the neighborhood right under the toner exhaust port 131.

Figure 2:
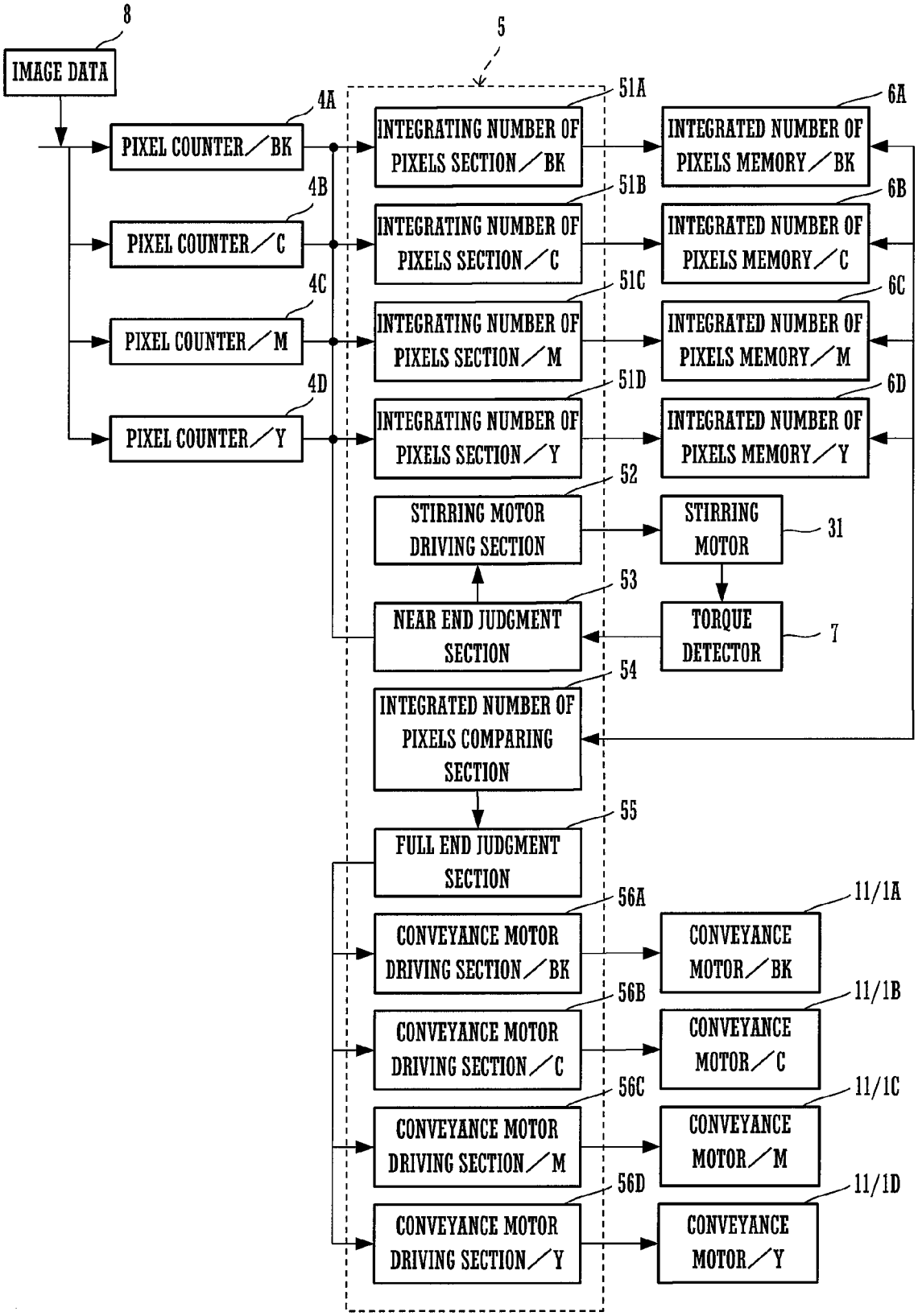
FIG. 2 is a block diagram showing a control system relating to the waste toner collector of the image forming apparatus according to the embodiment of the present invention.

FIG. 2 is a block diagram showing a control system relating to the above-mentioned waste toner collector 100. As shown in FIG. 2, a control section 5 configured with CPU and so forth includes integrating number of pixels sections 51A through 51D, a stirring motor driving section 52, a near end judgment section 53, an integrated number of pixels comparing section 54, a full end judgment section 55 and conveyance motor driving sections 56A through 56D.

To the integrating number of pixels sections 51A through 51D are connected pixel counters 4A through 4D, respectively. The pixel counters 4A through 4D respectively count the numbers of pixels per color of image data 8. The integrating number of pixels sections 51A through 51D are configured so as to carry out an integration of the numbers of pixels per color of the image data 8 counted by the pixel counters 4A through 4D, each time an image forming is performed.

The stirring motor driving section 52 controls the operation of the stirring motor 31 of the waste toner stirring mechanism 3.

The near end judgment section 53 determines whether or not a quantity of the waste toner in the waste toner container 2 has attained a near end, which is a state close to fullness, and then controls the integrating number of pixels sections 51A through 51D and the stirring motor driving section 52.

To be concrete, when a torque detector 7 detecting the torque acting on a motor axis of the above-mentioned stirring motor 31 detects a torque that is not less than a predetermined value, the near end judgment section 53 determines that the near end is attained, and then causes the stirring motor 31 to stop by controlling the stirring motor driving section 52. In this manner, stirring of the waste toner in the waste toner container 2 stops when and after the near end has been attained; and then until the full end is attained, it is made possible for the waste toners falling from the toner exhaust ports 131 of the respective toner transport mechanisms 3 to be accumulated in the neighborhood right under the respective toner exhaust ports 131 (refer to FIG. 4).

Further, the near end judgment section 53, upon making a determination that the near end has been attained, starts carrying out an integration of the numbers of pixels per color of the image data 8 by means of the integrating number of pixels sections 51A through 51D. Integrated numbers of pixels are stored by respective integrated number of pixels memories 6A through 6D, and are renewed each time an image forming is performed.

The torque detector 7 is an example of a near end detector of the present invention, but the near end detector is not limited to such. For instance, it can be constituted with a sensor optically detecting a top surface height of the waste toner accumulated in the waste toner container 2.

The conveyance motor driving sections 56A through 56D control the operation of the conveyance motors 11 of the above-mentioned waste toner transport mechanisms 1A through 1D.

The integrated number of pixels comparing section 54 compares the integrated numbers of pixels per color stored by the integrated pixel number memories 6A through 6D with a predetermined value, and outputs its result to the full end judgment section 55.

The full end judgment section 55 determines whether or not a quantity of the waste toner in the waste toner container 2 has attained the full end, which is a state of fullness, and then, depending on its result, controls the conveyance motor driving sections 56A through 56D. Concretely, when the output is made from the integrated number of pixels comparing section 54 indicating that the predetermined value has been reached by any one of the integrated numbers of pixels per color, the full end judgment section 55 determines that the full end is attained; at which the quantity of the waste toner in the waste toner container 2 has reached the state of fullness, and then, by controlling the conveyance motor driving sections 56A through 56D, causes the conveyance motors 11 of the respective waste toner transport mechanisms 1A through 1D to stop. In this manner, conveyance of the waste toner to the waste toner container 2 stops when the full end has been attained, and thereafter receiving the waste toner is brought to a halt. Further, some indication or sign is produced with this timing to prompt a user to replace the waste toner container 2 using a displaying means or the like of the image forming apparatus; and until replacement of the waste toner container is completed, the image forming apparatus is maintained in its stand-by state so as not to accept a new image data input.

Figure 3:
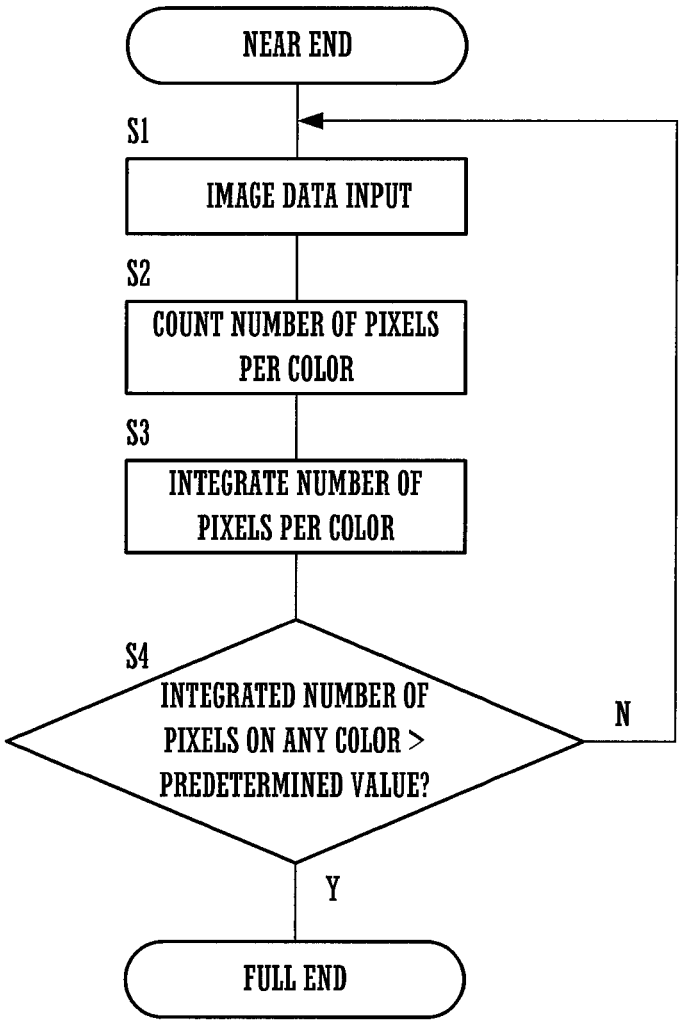
FIG. 3 is a flow to determine a full end by the waste toner collector of the image forming apparatus according to the embodiment of the present invention.

To summarize the aforementioned full end determination using a flow chart of FIG. 3, when the image data are inputted after the near end (S1), the numbers of pixels are counted per color (S3) and the numbers of pixels are integrated per color (S4); then, when any of the integrated numbers of pixels per color has reached a predetermined value, a determination is made that the full end is attained, at which the quantity of the waste toner in the waste toner container 2 reaches the state of fullness (S4).

Figure 4:
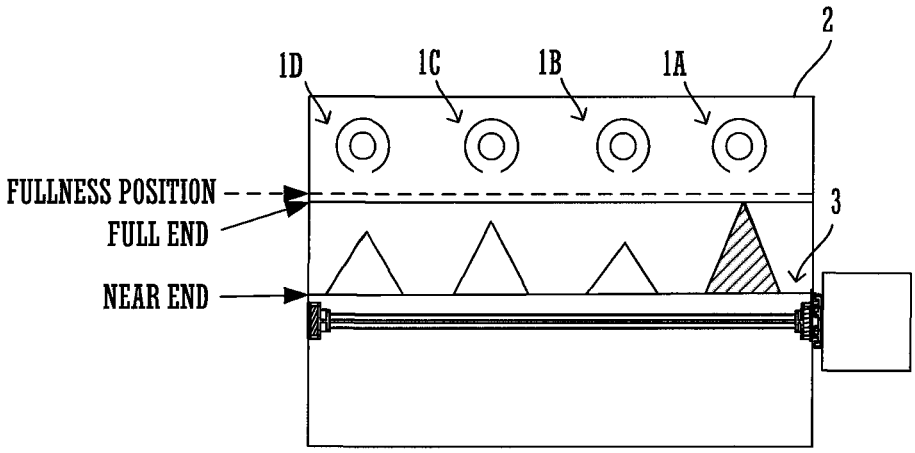
FIG. 4 is a schematic depiction showing an example of a state inside the waste toner container at the time of full end determination by the waste toner collector of the image forming apparatus according to the embodiment of the present invention.

As a result, as shown in FIG. 4, it is made possible to get a peak position of the waste toner at the time of the full end determination to come close to a predetermined fullness position of the waste toner container 2.

As the use of this embodiment enables the counted numbers of pixels to be integrated per color and thereby the full end to be determined, an adequate full end determination reflecting the image data can be performed. That is, fullness of the waste toner received in the waste toner container 2 can be determined as precisely as possible.

Further, the embodiment can be modified to perform in such a manner that monochromatic image forming with black toner is allowed to continue until the integrated number of pixels on black reaches the predetermined value even after the full end has been detected in a case where a color of which integrated number of pixels has first reached a predetermined value is any of the colors other than black. To be concrete, as shown in a flow of FIG. 5, in the case where the color of which integrated number of pixels has first reached a predetermined value is any color other than black (negative determination at S5), and when the image data are inputted (S6), a determination is made as to whether the image is a monochromatic image or not using the pixel counters 4A through 4D (S7); and if it is a monochromatic image (affirmative determination at S7), the number of pixels on black is counted and integrated (S8, S9). Then, with the flow returned to S6, the monochromatic image forming with black toner is continued until the integrated number of pixels on black reaches the predetermined value. If the determination is not a monochromatic image, that is to say a color image at S7 (negative determination), the image forming is suspended (S11).

Figure 5:
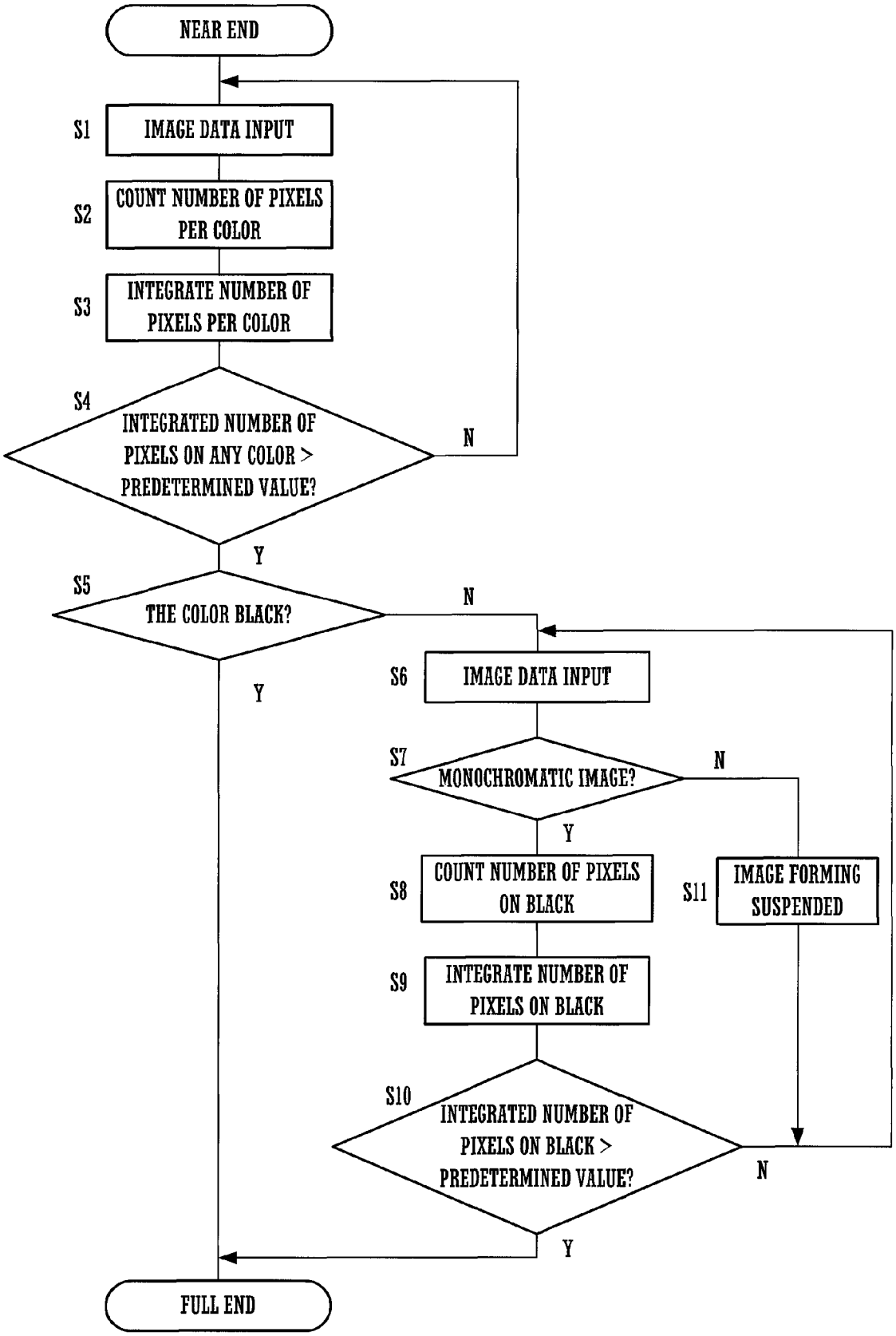
FIG. 5 is another example of a flow to determine the full end by the waste toner collector of the image forming apparatus according to the embodiment of the present invention.
Figure 6A:
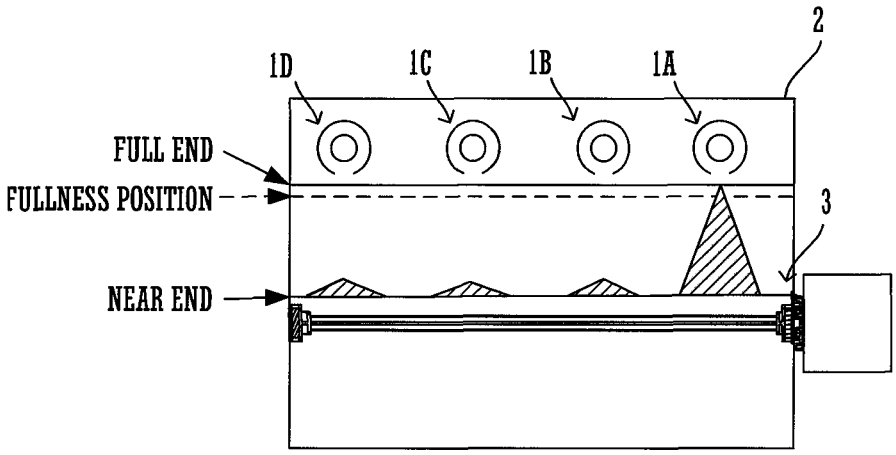
FIG.6A RELATED ART
FIG. 6A is a schematic depiction showing an example of a state inside a waste toner container at the time of full end determination by a waste toner collector of a conventional image forming apparatus.
Figure 6B:
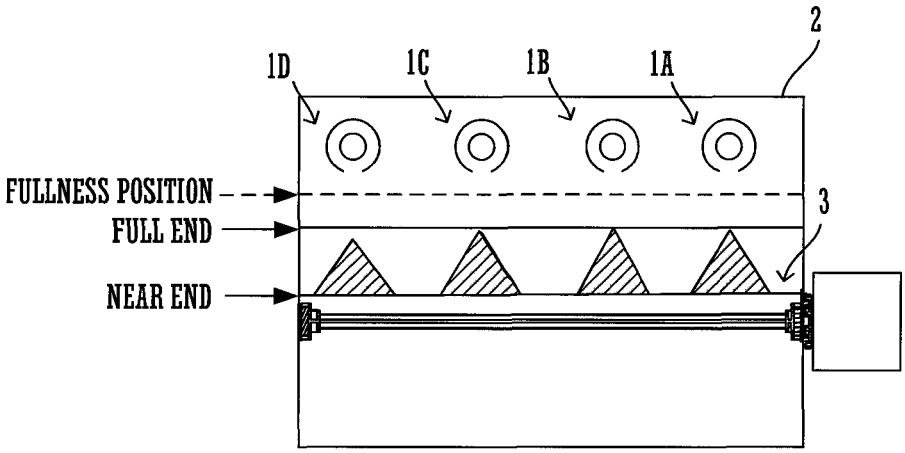
FIG.6B RELATED ART
FIG. 6B is a schematic depiction showing another example of a state inside the waste toner container at the time of full end determination by the waste toner collector of the conventional image forming apparatus.

Implementing the example of FIG. 5 enables a period for the replacement of the waste toner container 2 to be extended to some degree. Also, by making an addition to the example of FIG. 5, the embodiment may be modified to perform in such a manner that color image forming with toners other than black is allowed to continue until an integrated number of pixels on other than black reaches the predetermined value even after the full end has been detected in a case where the color of which integrated number of pixels has first reached a predetermined value is black.

Although the numbers of pixels per color are counted by the pixel counters in the above-mentioned embodiment, setting the numbers of pixels beforehand that are to be counted step by step depending on the printing index can be an alternative. Employing this procedure makes it unnecessary to use pixel counters per color, and then makes it sufficient to use just one pixel counter counting the whole number of pixels to find the printing index, thereby promoting cost reduction of the apparatus.

The above explanation of the embodiment is nothing more than illustrative in any respect, nor should be thought of as restrictive. Scope of the present invention is indicated by claims rather than the above embodiment. Further, it is intended that all changes that are equivalent to a claim in the sense and realm of the doctrine of equivalence be included within the scope of the present invention.

What is claimed is:

1. An image forming apparatus that carries out processes including visualizing image data formed as an electrostatic latent image on photoreceptors using toners of a plurality of colors, forming a color image through transferring the visualized image on paper, and collecting waste toners remaining on the photoreceptors in a waste toner container, the image forming apparatus comprising:

a plurality of waste toner transport mechanisms that respectively convey waste toners per color;

a waste toner container that receives collectively each waste toner conveyed by each waste toner transport mechanism;

a near end detector that detects a near end, at which a quantity of waste toner in the waste toner container is close to fullness;

a pixel counter that counts per color the number of the pixels of the image data;

an integrated number of pixels memory that stores a result of an integration of the numbers of the pixels per color of the image data counted by the pixel counters after the near end detection has been made by the near end detector, the integration being carried out by an integrating number of pixels section each time an image forming is performed;

a waste toner stirring mechanism that stirs the waste toner in the waste toner container; and a full end judgment section that stops the waste toner stirring mechanism after the near end is detected by the near end detector and that makes a judgment that full end, at which a quantity of the waste toner in the waste toner container reaches fullness, is attained when any one of the integrated numbers of pixels per color stored by the integrated number of pixels memory reaches a predetermined value.

2. The image forming apparatus as claimed in claim 1 wherein the plurality of waste toner transport mechanisms are each provided with a toner exhaust port, the toner exhaust ports being disposed abreast in a horizontal direction inside the waste toner container.

3. The image forming apparatus as claimed in claim 2, wherein monochromatic image forming with black toner is allowed to continue until the integrated number of pixels on black reaches the predetermined value even after the full end has been detected in a case where a color of which integrated number of pixels has first reached a predetermined value is any of the colors other than black.

4. The image forming apparatus as claimed in claim 1, wherein monochromatic image forming with black toner is allowed to continue until the integrated number of pixels on black reaches the predetermined value even after the full end has been detected in a case where a color of which the integrated number of pixels has first reached the predetermined value is any of the colors other than black.

5. A control method of image forming apparatus that carries out processes including visualizing image data formed as an electrostatic latent image on photoreceptors using toners of a plurality of colors, forming a color image through transferring the visualized image on paper, conveying per color waste toners remaining on the photoreceptors, and collecting the waste toners collectively in a waste toner container that has a waste toner stirring mechanism, the control method comprising:

a step that detects a near end, at which a quantity of waste toner in the waste toner container is close to fullness;

a step that the waste toner stirring mechanism is stopped after the near end is detected;

a step that carries out, after the near end detection, an integration of the numbers of the pixels per color of the image data each time an image forming is performed; and a step that makes a judgment that full end, at which a quantity of the waste toner in the waste toner container reaches fullness, is attained when any one of the integrated numbers of pixels per color reaches a predetermined value.

6. The control method of image forming apparatus as claimed in claim 5, wherein monochromatic image forming with black toner is allowed to continue until the integrated number of pixels on black reaches the predetermined value even after the full end has been detected in a case where a color of which integrated number of pixels has first reached a predetermined value is any of the colors other than black.

* * * * *